United States Patent [19]

Inoda et al.

[11] Patent Number: 4,742,679

[45] Date of Patent: May 10, 1988

[54] STIRLING ENGINE

[75] Inventors: Kenichi Inoda, Hirakata; Terumaru Harada, Moriguchi; Tatsuo Fujita, Hirakata; Kin-ichi Adachi, Takarazuka, all of Japan

[73] Assignee: Matsushita Electric Industrial Co., Ltd., Osaka, Japan

[21] Appl. No.: 929,808

[22] Filed: Nov. 13, 1986

[30] Foreign Application Priority Data

Nov. 18, 1985 [JP] Japan ..... 60-258031

[51] Int. Cl.[4] ..... F02G 1/04

[52] U.S. Cl. ..... 60/517; 60/520

[58] Field of Search ..... 60/517, 520, 525, 526; 62/6

[56] References Cited

U.S. PATENT DOCUMENTS 4,490,974 1/1985 Colgate ..... 60/517 X

FOREIGN PATENT DOCUMENTS 104550 8/1980 Japan ..... 60/517

113938 7/1982 Japan ..... 60/517

*Primary Examiner*—Stephen F. Husar

*Attorney, Agent, or Firm*—Wenderoth, Lind & Ponack

[57] ABSTRACT

The present invention relates to a Stirling engine which includes a first wall member forming a part of a vessel, a second wall member forming a part of the vessel, a third wall member forming a part of the vessel which is transformable and at the same time the transformation of which can change the positional relationship of the second wall member relative to the first wall member, a working fluid sealed in the vessel, a heater for heating the working fluid in the vessel through the first wall member, a cooler for cooling the working fluid in the vessel through the second wall member, a regenerator and a mechanical device which is driven by the working fluid when the working fluid is moved relative to the second wall member to change the pressure so that a part of the heat generated by the heater and transferred to the working fluid is used for driving the mechanical device. The first and second wall members are not connected by a bolt and a nut as in the prior art, but are connected to each other, for example, by bellows. Therefore, according to the present invention, the heat lost from the first wall member to the second wall member is reduced to enhance the thernal efficiency of the Stirling engine.

6 Claims, 3 Drawing Sheets

STIRLING ENGINE

BACKGROUND OF THE INVENTION

The present invention generally relates to an external combustion engine which is a kind of a heat engine, and, more particularly, to an external combustion engine of the Stirling engine type.

The Stirling engine referred to above is generally comprised of a hermetically sealed vessel, a working fluid such as helium or hydrogen sealed in the vessel, a heater for heating the working fluid, a cooler for cooling the working fluid, a regenerator which stores heat while the working fluid reciprocates between the heater and the cooler, and a mechanical means such as a piston or the like which is driven by the working fluid. The working fluid is continuously heated and cooled while making a reciprocal movement between the heater and the cooler and, as a result, the working fluid is repeatedly compressed and expanded. Because of the aforementioned structure in the Stirling engine, the working fluid acts on an external load while making changes intimate to the Stirling cycle.

The construction of the prior art Stirling engine is as shown in FIG. 4.

More specifically, in the prior art Stirling engine, a working fluid such as helium or hydrogen is hermetically filled in a sealed vessel formed by walls 1 and 2. The Stirling engine includes a pipe 3 to be heated for heating the working fluid, a cooler passage 4 in which the working fluid is cooled, and a regenerator matrix 5. A displacer 6 is movable up-and-down so as to reciprocate within the wall 1, while maintaining a small clearance from the inner surface of the wall 1. Moreover, a piston 7 is arranged to be slidable over the inner surface of the wall 2 when undergoing up-and-down reciprocation. The piston 7 acts on a load 8 of a linear alternator, a compressor or a pump, etc., which is secured at one end to the inner surface of the wall 2, and at the other end to the piston 7. Springs 9 and 10 support the wall 2 on a base 11. Compression spaces 17 and 19 communicate with each other through passageways 20 and 21.

Meanwhile, the wall 1 is fixed to the wall 2 by a plurality of sets of bolts 12 and nuts 13. An insulation member 14 is sandwiched between the walls 1 and 2.

The outer surface of the pipe 3 is heated by a heat source such as combustion gas of fossil fuels or solar energy.

The working fluid in the cooler passage 4 is cooled by a coolant which enters from a pipe 15 to run along the outer wall of the wall 2 to a pipe 16.

The operation of the prior art Stirling engine having the above-described construction will now be explained.

When the displacer 6 is lowered, the cubic volume of the compression space 17 is reduced, while that of an expansion space 18 is increased. Therefore, the pressure in the compression spaces 17 and 19 becomes higher than the pressure in the expansion space 18. As a result, because of this difference in pressure, the working fluid at low temperatures in the compression spaces 17 and 19 and the cooler passage 4 is, through the regenerator matrix 5 and the pipe 3, sent towards the expansion space 18. During this time, the working fluid is heated by the regenerator matrix 5 and the pipe 3. On the contrary, the regenerator matrix 5 is cooled. Thus, since the working fluid at low temperatures is heated, the pressure in the space filled with the working fluid over the piston 7 (hereinafter referred to as a working space) is raised, thereby drawing the piston 7. At this time, the piston 7 down acts on the load 8. On the other hand, when the displacer 6 continues to be lowered, the pressure in a gas spring 22 is gradually increased. And finally, the displacer 6 stops, and then, conversely, begins to ascend. When the displacer 6 is raised, the cubic volume of the compression space 17 is increased, while that of the expansion space 18 is reduced. Due to this change, the pressure in the expansion space 18 becomes higher than that in the compression spaces 17 and 19. The difference in pressure brings the working fluid at high temperatures in the expansion space 18 and the pipe 3 towards the compression space 17 through the regenerator matrix 5 and the cooler passage 4. At this time while the working fluid flows from the expansion space 18 to the compression space 17, it is cooled by the regenerator matrix 5 and the inner wall of the cooler passage 4. The regenerator matrix 5 is conversely heated. As described hereinabove, the working fluid at high temperatures is cooled, and accordingly the pressure in the working space is lowered, thereby raising the piston 7. At this time, the piston 7 drives the load 8.

In the meantime, if the displacer 6 continues to ascend, the pressure of the gas spring 22 is gradually reduced, until the displacer 6 stops and then begins to lower. In the process of one cycle as above, the working fluid changes a part of the heat added through the pipe 3 to drive the load 8, while leaving a part of the heat to the inner wall of the cooler passage 4.

The heat entering from the heat source into the pipe 3 is largely included in the working fluid. However, it partially flows through the pipe 3 to the wall 1, and further through the bolt 12 and the nut 13 to the wall 2 to be transmitted to the coolant.

In the manner as described above, a part of the heat entering from the heat source to the pipe 3 is transmitted not to the working fluid, but to the coolant. The reason for this is that the temperature of the heat source is higher than the temperature of the coolant. Although the insulation member 14 prevents some heat from being transmitted from the wall 1 to the wall 2, some actual heat is transmitted from the wall 1 to the wall 2 through the bolt 12 and the nut 13. Thus, such heat is actually present that is not transmitted to the working fluid, but is transmitted to the coolant. Therefore, the thermal efficiency of the prior art Stirling engine is disadvantageously low.

SUMMARY OF THE INVENTION

Accordingly, the present invention has been developed with a view to substantially eliminates the above-described disadvantage inherent in the prior art, and has for its essential object to provide an improved Stirling engine which comprises a first wall member constituting a part of the vessel, a second wall member constituting a part of the vessel, and a third wall member constituting a part of the vessel which is transformable by itself and at the same time the transformation of which can change the positional relationship of the second wall member relative to the first wall member.

In accomplishing the above-described object, according to the present invention, the Stirling engine includes a working fluid sealed in the vessel, a heater means for heating the working fluid in the vessel through the first wall member, a cooler means for cooling the working fluid in the vessel through the second wall member, a regenerator, and a mechanical means which is driven relative to the second wall member and in response to the pressure change of the working fluid so that a part of the heat transferred to the working fluid that is generated by the heater means is used to drive the mechanical means. In the construction as described above, the first wall member is heated by the heater means, while the second wall member is cooled by the cooler means. Therefore, the temperature of the first wall member is higher than that of the second wall member, so that the heat is transferred from the first wall member through the third wall member to the second wall member. The third wall member is made of, for example, bellows, which is transformable by itself. Accordingly, the third wall member has a large thermal resistance compared to the prior art wherein the first and the second wall members are tied to each other by pairs of bolts and nuts. The Stirling engine of the present invention is therefore advantageous in that the heat value transmitted from the first wall member to the second wall member is reduced, enhancing the thermal efficiency.

BRIEF DESCRIPTION OF THE DRAWINGS

This and other objects and features of the present invention will become apparent from the following description taken in conjunction with preferred embodiments thereof with reference to the accompanying drawings, in which.

DESCRIPTION OF PREFERRED EMBODIMENTS

Figure 1:
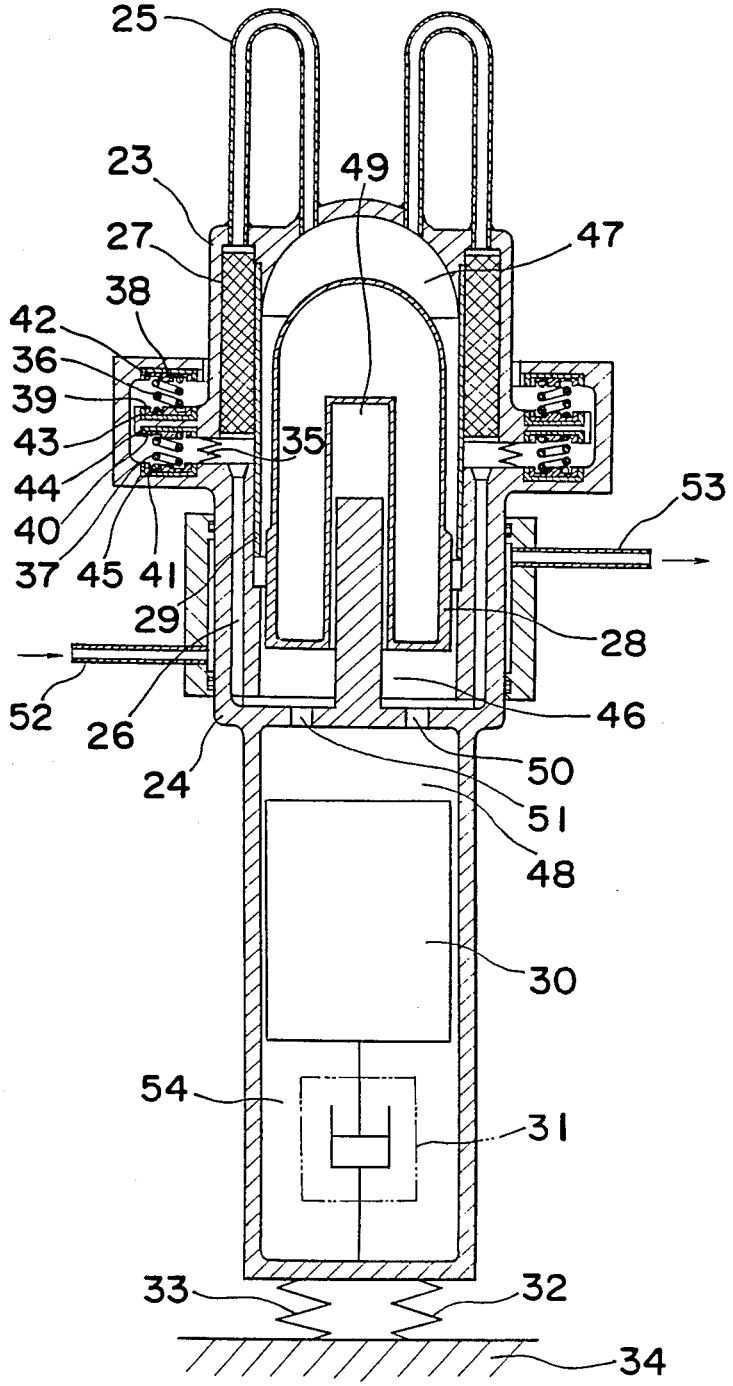
FIG. 1 is a cross sectional view of a free-piston Stirling engine according to a first embodiment of the present invention.
Figure 2:
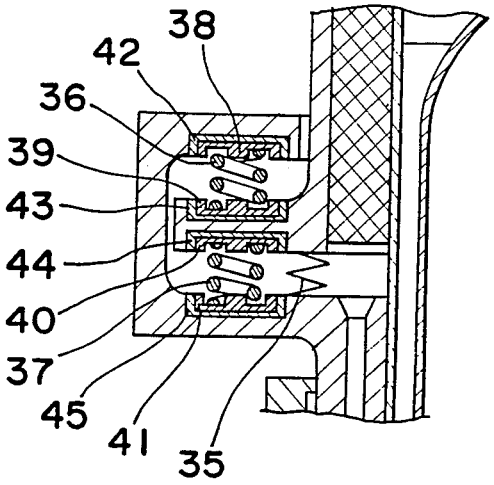
FIG. 2 is an enlarged view of an essential portion of FIG. 1.

Before the description of the present invention proceeds, it is to be noted here that like parts are designated by like reference numerals throughout the accompanying drawings.

With reference to FIG. 1, the construction of a free-piston Stirling engine according to a first embodiment of the present invention will be described first.

The Stirling engine shown in FIG. 1 has a working fluid sealed in a sealed vessel which is formed by a first wall member 23 and a second wall member 24. The working fluid is, for example, helium or hydrogen, etc. The Stirling engine is provided with a heating pipe 25 to be heated for heating the working fluid, a cooler passage 26 for cooling the working fluid, and a regenerator matrix 27. The Stirling engine further includes a displacer 28 which is movable up-and-down so as to reciprocate within the wall member 23, while maintaining a small clearance from both the inner wall of the wall member 23 and a thin ring 29. A piston 30 is movable up-and-down so as to reciprocate and slide along the inner surface of the wall member 24. A load 31 has one end secured to the inner surface of the wall member 24 and, the other end secured to the piston 30, so that the load 31 for a linear alternator, a compressor or a pump, etc. is driven by the reciprocal movement of the piston 30. The wall member 24 is supported on a base 34 by a pair of springs 32 and 33. A compression space 46 communicates with a compression space 48 through passages 50 and 51.

Moreover, the Stirling engine is provided with a third wall member, that is, bellows 35 extending between the first and the second wall members 23 and 24 in such manner as to form a hermetically sealed vessel in conjunction with the first and the second wall members, such that the working fluid is prevented from leaking outside.

Compression coil springs 36 and 37 are also provided respectively in plural numbers in the outer periphery of the sealed vessel so as not to allow the first wall member 23 to separate from the second wall member 24 if the pressure of the working fluid destroys the bellows 35. For securing end portions of the compression coil springs 36 and 37 so as not to move in a direction orthogonal to an axis, a metal fitting 38 is placed between the compression coil spring 36 and the second wall member 24, a metal fitting 39 between the compression coil spring 36 and the first wall member 23, a metal fitting 40 between the compression coil spring 37 and the first wall member 23 and a metal fitting 41 between the compression coil spring 37 and the second wall member 24. Furthermore, insulation materials 42, 43, 44 and 45 are sandwiched respectively between the metal fitting 38 and the second wall member 24, between the metal fitting 39 and the first wall member 23, between the metal fitting 40 and the first wall member 23, and between the metal fitting 41 and the second wall member 24 for the purpose of reducing the heat conductivity.

These compression coil springs 36 and 37, metal fittings 38 to 41 and insulation materials 42 to 45 are formed into one set, and the Stirling engine of the present invention is arranged with a plurality of the sets.

The outer surface of the heating pipe 25 is heated by a heat source such as combustion gas of fossil fuels or solar energy, etc.

The working fluid within the cooler passage 26 is cooled by coolant entering from a pipe 52 and travelling along the outer surface of the wall member 24 until exiting from a pipe 53.

Now, the operation of the Stirling engine will be described. When the displacer 28 descends, the cubic volume of a compression space 46 is reduced, while that of an expansion space 47 is increased. Accordingly, the pressure in the compression space 46 and naturally in a compression space 48 becomes higher than the pressure in the expansion space 47. As a result, the working fluid at low temperatures in the compression space 46 and the cooler passage 26 flows through the regenerator matrix 27 and the heating pipe 25 towards the expansion space 47. During the movement, the working fluid is heated by the regenerator matrix 27 and the heating pipe 25. Conversely, the regenerator matrix 27 is cooled. Thus, in accordance with heating of the working fluid of low temperatures, the pressure in a space over the piston 30 and filled with the working fluid (referred to as a working space hereinafter) is raised, thereby lowering the piston 30. At this time, the piston 30 acts on the load 31. On the other hand, if the displacer 28 continues to descend, the pressure of a gas spring 49 is gradually increased. Then, the displacer 28 stops, and then begins to rise. The rising of the displacer 28 increases the cubic volume of the compression space 46, while reducing the cubic volume of the expansion space 47. Consequently, since the pressure in the expansion space 47 is rendered higher than that in the compression space 46, the working fluid at high temperatures within the expansion space 47 and the heating pipe 25 is sent to the compression space 46 through the regenerator matrix 27 and the cooler passage 26. At this time, the working fluid is cooled by the regenerator matrix 27 and the inner wall of the cooler passage 26. On the contrary, the regenerator matrix 27 is heated at this time. In the manner above, the working fluid of high temperatures is cooled and accordingly, the pressure in the working space is lowered. As a result, the piston 30 is raised. At this time, the piston 30 acts on the load 31.

If the displacer 28 continues to be raised, the pressure of the gas spring 49 is gradually reduced. After the displacer 28 finally stops, it begins to fall. In the aforementioned process in one cycle, the working fluid changes a part of the heat added by the heating pipe 25 to drive the load 31, while leaving the heat partially behind the inner wall of the cooler passage 26.

Furthermore, since the pressure in the expansion space 47 and in a bounce space 54 is changed during the operation of the Stirling engine, the distance between the wall members 23 and 24 is varied. However, the expansible and contractable bellows 35 can follow the change of the distance between the wall members 23 and 24 so that the Stirling engine is prevented from being disabled. Moreover, the thin ring 29 pressed into the wall member 23 is arranged to be slidable while maintaining a small clearance from the wall member 24. Accordingly, even when the distance between the wall members 23 and 24 is changed, the coaxial degrees of each of the wall members 23 and 24 can be maintained. Although the heat entering from the heat source to the heating pipe 25 is mostly transmitted to the working fluid, a portion of the heat is transferred along the heating pipe 25 to the wall member 23.

Thereafter, the heat transferred to the wall member 23 is further transferred, through the bellows 35, or the insulation materials 42, 43, 44 and 45, metal fittings 38, 39, 40 and 41, and the compression coil springs 36 and 37 which are absorbing means for the wall members 23 and 24, to the second wall member 24 to the coolant.

Consequently, such heat is transmitted to the coolant, without being transmitted to the working fluid, after which the working fluid is sent into the heating pipe 25, resulting in reduction of the thermal efficiency. According to the first embodiment of the present invention as described above, however, the wall members 23 and 24 are connected to each other through the bellows 35, the insulation materials 42, 43, 44 and 45, the metal fittings 38, 39, 40 and 41 and the compression coil springs 36 and 37. In addition, both of the wall members 23 and 24 are designed to have higher thermal resistance compared to those of the prior art. In other words, the bellows 35 is manufactured from a cylinder made of a thin plate, or from thin plates layered one on another, and the opposite ends of the layers are welded. Therefore, the bellows 35 is able to have a large thermal resistance. On the other hand, the insulation materials 42, 43, 44 and 45 are made of a material which includes asbestos and is small in heat conductivity, and accordingly the insulation materials 42 to 45 also have high thermal resistance.

As is mentioned above, in the Stirling engine of the first embodiment of the present invention, the wall members 23 and 24 are connected to each other by material higher in thermal resistance than in the prior art, and therefore the Stirling engine of the present invention is advantageous in an increased thermal efficiency and the reduction of the fuel amount consumed for the heat source.

Figure 3:
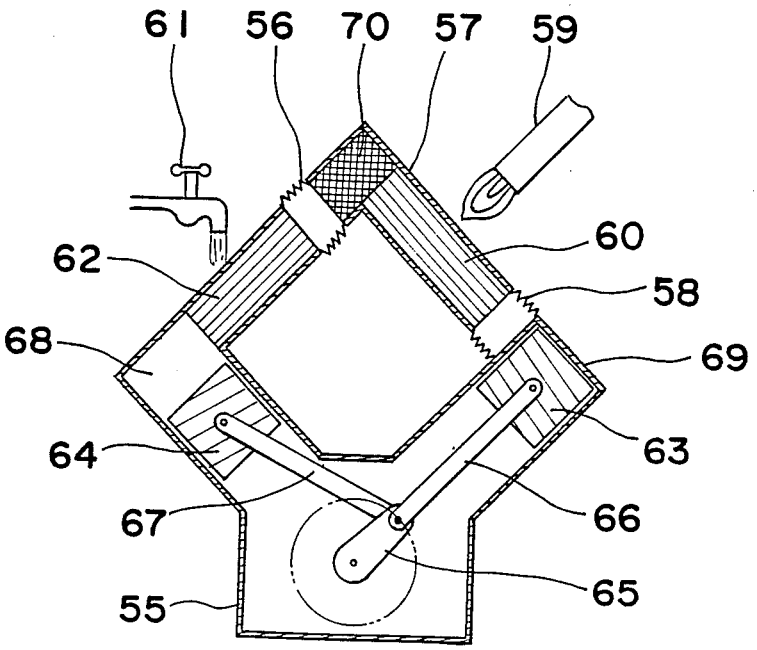
FIG. 3 is a cross sectional view of a two-piston Stirling engine having an expansion piston and a compression piston according to a second embodiment of the present invention.
Figure 4:
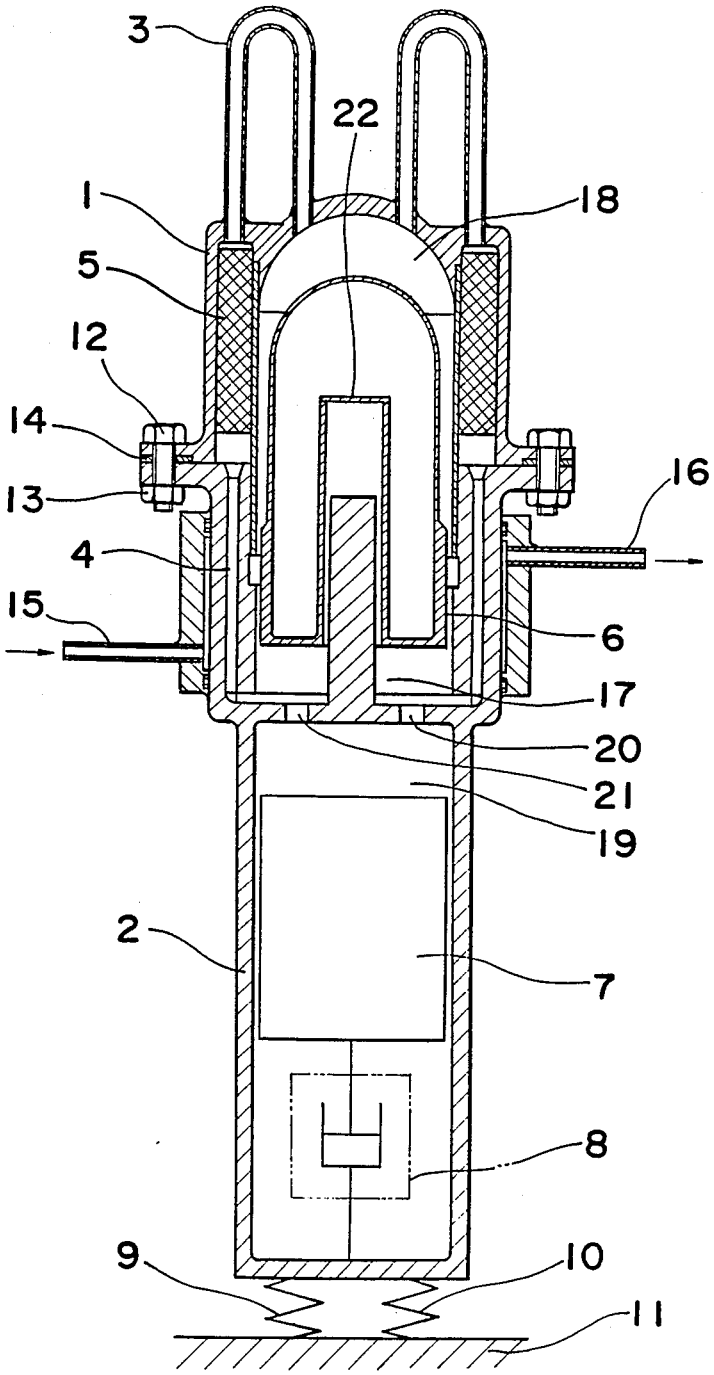
Fig. 4 PRIOR ART
FIG. 4 is a cross sectional view of a prior art free-piston Stirling engine.

Referring to FIG. 3, a Stirling engine according to a second embodiment of the present invention will be described hereinbelow.

The Stirling engine according to the present embodiment is different from the Stirling engine of the first embodiment in the model of the engine. More specifically, the Stirling engine of the second embodiment is a two-piston Stirling engine which has two pistons, that is, an expansion piston and a compression piston, the construction of which will be described first hereinafter.

In FIG. 3, the working fluid for the Stirling engine such as helium or hydrogen is hermetically sealed in a sealed vessel composed of wall members 55 and 57, and bellows 56 and 58. The Stirling engine is also provided with a combustor 59 for heating heater 60, a coolant supplying device 61 for cooling a cooler 62, a regenerator 70, an expansion piston 63, a compression piston 64, a crank shaft 65 and connecting rods 66 and 67.

The Stirling engine of the above-described construction operates in the manner as follows. Namely, when the crank shaft 65 is rotated, the compression piston 64 and the expansion piston 63 are accordingly moved. Consequently, the cubic volume in both a compression space 68 and an expansion space 69 is periodically changed, bringing about the reciprocating motion of the working fluid between the compression space 68 and the expansion space 69. While the working fluid is flowing, it is heated by the heater 60 and cooled by the cooler 62 to be expanded and compressed. As a result, the working fluid acts on the crank shaft 65.

Meanwhile, since the wall member 57 is heated by the combustor 59 and the wall member 55 is cooled by the coolant, the temperature at the wall member 57 is higher than that at the wall member 55.

According to the second embodiment, it is so arranged with the bellows 56 and 58 that the heat is prevented from being transmitted from the wall member 57 to the wall member 55. Accordingly, in comparison with the prior art engine having no such bellows, the Stirling engine of the present embodiment is advantageous in that the heat we transferred to the working fluid from the combustor 59 is less transmitted through the wall member 57 to the wall member 55 to be left behind the coolant, enhancing the thermal efficiency.

Although there are employed bellows 35, 56 and 58 in the foregoing embodiments of the present invention, other kinds of means having the same function as the bellows 35, 56 and 58 can be utilized. For example, a diaphragm or the like may give the same effect as the bellows 35, 56 and 58.

Moreover, the present invention is directed to the free-piston Stirling engine which is a kind of a piston-and-displacer Stirling engine and the two-piston Stirling engine having an expansion piston and a compression piston respectively in the first and the second embodiments. However, the present invention can be applied in any kind or design of a Stirling engine as long as the engine has the working fluid sealed in a vessel, for example, not only other kinds of the piston-and-displacer Stirling engine and the two-piston Stirling engine, but other Stirling engines as well.

Furthermore, although the compression springs 36 and 37 are provided in the Stirling engine of the first embodiment so that the bellows 35 are prevented from being destroyed when the pressure of the working fluid is high enough to separate the wall member 23 from the wall member 24, the compression springs 36 and 37, the metal fittings 38 to 41, and the insulation materials 42 to 45 can be dispensed with when the pressure of the working fluid is always low enough so as not to destroy the bellows. In the second embodiment, the compression springs, the metal fittings and the insulation materials are not shown.

As is described hereinabove, the Stirling engine of the present invention is comprised of a first wall member constituting a part of a vessel, a second wall member constituting a part of the vessel, a third wall member constituting a part of the vessel and provided in the first and the second wall members which is transformable by itself and at the same time the transformation of which can change the positional relationship of the second wall member relative to the first wall member, a working fluid sealed in the vessel, a heater means for heating the working fluid within the vessel through the first wall member, a regenerator, a cooler means for cooling the working fluid within the vessel through the second wall member, and a mechanical means which is driven as a result of the pressure change in the working fluid when the working fluid is moved relative to the second wall member, thereby to change a part of the heat generated by the heater means and transferred to the working fluid for driving the mechanical means. Because of the aforementioned construction, according to the Stirling engine of the present invention, the heat transmitted from the first wall member to the second wall member through the third wall member is much more reduced due to the characteristics of the third wall member having high thermal resistance, as compared with the prior art, and therefore the thermal efficiency is increased. The heat value necessary per one cycle of operation of the engine is reduced, resulting in saving of cost.

What is claimed is:

1. A Stirling engine comprising:

a first wall chamber constituting a part of a vessel in which a working fluid is sealed;

a second wall chamber constituting a part of said vessel;

a third wall chamber constituting a part of said vessel;

a heater means for heating the working fluid through said first wall chamber;

a cooler means for cooling the working fluid through said second wall chamber;

a regenerator provided between a heating space in said vessel which is heated by said heater means and a cooling space in said vessel which is cooled by said cooler means; and a mechanical means which is driven as a result of movement of and a pressure change in the working fluid, said third wall chamber comprising a bellows and having a larger thermal resistance than said first and said second wall chambers, said third wall chamber connecting said first wall chamber with said second wall chamber in such a manner that the positional relationship of said first wall chamber relative to said second wall chamber can be changed.

2. A Stirling engine as claimed in claim 1, wherein a first flange portion extends from said first wall chamber and is connected by a coil spring through insulation material to a second flange portion extending from said second wall member.

3. A Stirling engine as claimed in claim 2, wherein said second flange portion extends over upper and lower surfaces of said first flange portion, each of said surfaces operatively coupled to a coil spring and an insulation material so as to be elastically coupled to said second flange portion.

4. A Stirling engine as claimed in claim 1, wherein said mechanical means comprises a displacer moving between said second heating space, said heating space being an expansion space, and said cooling space, said cooling space being a compression space, and a piston moving in association with said displacer within the compression space, said mechanical means acting on a load through said piston.

5. A Stirling engine as claimed in claim 4, and further comprising a ring provided between said first wall chamber and said second wall chamber for preventing said first wall chamber from swinging relative to said second wall chamber.

6. A Stirling engine as claimed in claim 1, wherein said first wall chamber is tubular and has one end thereof connected to the third wall chamber through said regenerator, and the other end thereof connected to a fourth wall chamber through said heating space, and said mechanical means includes a compression piston and an expansion piston connected through respective connecting rods to a common crank shaft in said second wall chamber so that said crank shaft is rotated by alternating reciprocal movement of said compression piston and said expansion piston, the space in which said compression piston reciprocates opposing said third wall member across said cooling space, and the space in which said expansion piston reciprocates being adjacent said fourth wall chamber.

* * * * *